US010184253B1

(12) United States Patent
Ryan

(10) Patent No.: US 10,184,253 B1
(45) Date of Patent: Jan. 22, 2019

(54) CONCRETE ROOF DECK VENTILATION DUCTS

(71) Applicant: Kevin Patrick Ryan, Zionsville, PA (US)

(72) Inventor: Kevin Patrick Ryan, Zionsville, PA (US)

( * ) Notice: Subject to any disclaimer, the term of this patent is extended or adjusted under 35 U.S.C. 154(b) by 0 days.

(21) Appl. No.: 15/802,866

(22) Filed: Nov. 3, 2017

(51) Int. Cl.
*E04B 1/00* (2006.01)
*E04F 13/00* (2006.01)
*E04D 13/17* (2006.01)
*E04B 1/70* (2006.01)

(52) U.S. Cl.
CPC ..... *E04F 13/007* (2013.01); *E04B 1/7069* (2013.01); *E04D 13/172* (2013.01)

(58) Field of Classification Search
CPC ..... E04F 13/007; E04B 1/7069; E04B 7/00; E04B 9/02; E04D 13/17; E04D 13/172; E04D 13/178
See application file for complete search history.

(56) References Cited

U.S. PATENT DOCUMENTS 1,963,609 A * 6/1934 Balduf ..... E04B 1/7654 428/192
3,498,015 A * 3/1970 Green ..... E04D 7/00 52/302.1
3,884,009 A * 5/1975 Frohlich ..... E04D 11/02 52/302.1
3,962,841 A * 6/1976 Carroll ..... E04B 7/00 52/309.12
4,114,335 A * 9/1978 Carroll ..... E04B 2/60 52/302.1
4,189,886 A * 2/1980 Frohlich ..... E04D 7/00 52/302.1
4,267,678 A * 5/1981 Carroll ..... E04D 13/1606 52/309.12
4,977,714 A * 12/1990 Gregory, Jr. ..... E04D 13/172 454/260
5,317,852 A * 6/1994 Howland ..... E04D 11/02 52/11
5,596,847 A * 1/1997 Stephenson ..... E04D 13/172 52/198
5,765,329 A * 6/1998 Huang ..... E04D 3/30 165/49
6,061,973 A * 5/2000 Accardi ..... E04D 13/17 52/199
7,143,557 B1 * 12/2006 Ayers, Jr. ..... E04D 13/152 52/302.1
7,739,844 B2 * 6/2010 Gharibeh ..... B28B 19/003 52/309.8
7,765,757 B2 * 8/2010 Gembala ..... E04D 11/00 52/404.2
8,424,263 B2 * 4/2013 Hsieh ..... E04B 5/04 52/414

* cited by examiner

*Primary Examiner* — Beth A Stephan

(57) ABSTRACT

A roof construction method using expanded metal lath laid on top of corrugated metal roof deck for the purpose of creating ventilation ducts in the valleys of the corrugated metal deck. The ventilation ducts created are vented to the building space below through vent slots in the valleys of the metal roof deck. A concrete slab with finished rubber roof poured in top of this roof deck with ventilation ducts will have enhanced ability to release moisture trapped from the concrete curing process.

6 Claims, 2 Drawing Sheets

CONCRETE ROOF DECK VENTILATION DUCTS

FIELD OF THE INVENTION

The present invention relates to a roof construction method with built in venting features for removing excess moisture trapped in a cementitious roof slab enclosed by marginally vented metal roof deck below the slab, rigid insulation and/or continuous roofing above the slab. The venting feature provides for moisture removal even after the top surface of the roof construction is sealed by application of a finished waterproof roofing system. Mini ducts are formed by providing a barrier over the valleys of the corrugated roof deck preventing the roof slab from filling the valleys of the corrugated roof deck. The valleys of the deck are vented to the building space below. The barrier over the valleys is constructed of an expanded metal lath or wire mesh that holds concrete out of the metal deck corrugations while increasing the surface area of concrete exposed to air.

BACKGROUND OF THE INVENTION

Typical commercial flat roof construction often consists of steel joists spaced apart with corrugated metal roof deck spanning between the steel joists. Rigid insulation is glued on top of the corrugated roof deck and a rubber roof is applied on top of the rigid insulation as waterproofing. In 15% of buildings constructed in this manor, a concrete slab is placed on top of the corrugated metal roof before the rigid insulation is placed as a means of providing a code required fire rating to the roof assembly. When a concrete slab is poured it releases water vapor as it cures and hardens. This curing process can continue for over a month. However the rigid insulation and final finished rubber roof is applied on top of the concrete slab before the curing process is complete. The top of the concrete slab is sealed off by applied rigid insulation and rubber roof. The bottom of the concrete slab is sealed off by the continuous corrugated metal roof spanning between steel joists.

The moisture trapped inside the concrete slab as it continues to cure tries to escape the slab but can not. This trapped moisture can cause premature failure of the rigid insulation adhesive between the slab and the insulation. This trapped moisture can infiltrate the rigid insulation reducing its R value. This trapped moisture can also affect the bond of the rubber roofing reducing the life expectancy of the rubber roofing.

A solution to this trapped moisture is illustrated and detailed in prior art documented in U.S. Pat. No. 3,498,015 patented Mar. 3, 1970 by P. A. Seaburg ET AL—Poured Gypsum Roof Structure with Lower Vent Means for Removing Excess Moisture.

This prior art solved the issue of trapped moisture in a concrete roof slab by providing vent slots in the bottom of the corrugated steel deck valleys. A wicking material is placed in the corrugated steel deck valleys before the concrete is poured to absorb the moisture from the concrete. The wicking material can then release the trapped moisture to the building space below through the vent slots in the bottom of the valleys.

Roof construction using vented roof deck with wicking materials in the valley's of the corrugated steel vented roof deck has improved moisture removal from concrete poured on top of steel roof decks and covered on top with rigid insulation and rubber roofing, but experience has shown that premature failure of the rubber roofing adhesive and rigid insulation is still occurring that is attributed to excess moisture retained in the concrete slab.

It is therefore an objective of our invention to provide a method of roof construction using existing construction materials to increase the surface area air exposure on the bottom of slabs poured on top of corrugated steel roof deck to promote more efficient evaporation of moisture from the slab.

Expanded metal lath is a metal mesh currently used as a base for stucco wall construction on the exterior of buildings. The lath consists of gauge metal sheets that are perforated in a regular pattern. The sheets are then stretched to open up the perforations creating a pattern of small openings in the gauge metal sheets. The openings in the lath equates to 70% or more of the surface area of a finished sheet. The size of the holes are proportioned such that concrete will penetrate the holes slightly but will not pass through the holes.

Our invention is a method for using expanded metal lath as a form laid on top of corrugated metal roof deck to prevent a cementitious slab poured on top of a metal roof deck from entering the corrugations of the roof deck creating spaced apart mini air ducts out of each of the metal roof deck valleys. The mini air ducts consist of the two sides and one bottom of the valley of each corrugation of the metal roof deck and the op consists of the poured concrete slab in combination with the expanded metal lath form spanning across the corrugations.

Alternatively stucco mesh can also be manufactured of twisted wire mesh as opposed to expanded metal lath. This manufactured product can be substituted equally for expanded metal lath in this invention.

Sheet metal tek screws are sheet metal screws used to join two overlapping corrugated metal deck panels together. The tek screws have a drill bit tip to create the proper size hole through two lapped layers of gauge metal deck. The threaded shaft of the tek screw then draws together the two layers of lapped gauge metal deck. The head of the tek screw acts as a washer and a stop when the proper penetration is achieved.

A sheet metal tek screw would not be used to attach overlapping layers of expanded metal lath. The lath already has expanded holes in it. The threaded shaft of the tek screw would not properly engage the lath and would not draw together two layers of expanded metal lath.

Our invention uses sheet metal tek screws, normally used for connecting two layers of gauge sheet metal together, to connect together expanded metal lath lapped on top of corrugated roof deck. Sheet metal tek screws would be threaded through a hole in the expanded metal lath then drilled through the gauge metal corrugated roof deck. The threaded shaft of the tek screw would draw the screw down through the corrugated roof deck. The head of the tek screw acts as a washer and a stop to pinch the expanded metal lath down onto the corrugated roof deck. Sheet metal tek screws would be spaced at regular intervals to hold the expanded metal lath in place over the corrugations of the metal roof deck forming the tops of mini air ducts preventing concrete from flowing into the corrugations of the roof deck.

Metal roof deck can be ordered with vent slots in the horizontal gauge metal bottom of each valley. Vent slot openings can total up to 6% of the area on the bottom of each deck valley bottom. In contrast the expanded metal lath openings total 70% or more of the area on the metal lath. Under the previous art, air flow is limited to the 6% slot openings that are blocked by either concrete poured directly into the corrugated metal deck valleys or the wicking material laid in the valleys. Under our invention, with the metal deck valleys unblocked by concrete or wicking material, air can flow freely into the valleys of the metal roof deck. Differential temperature between the topside of the roof construction and the underside of the roof construction will naturally promote air movement through the unblocked vent slots. The air will move across the expanded metal lath with concrete poured on top. 70% openings expose more area on the bottom of the concrete slab to the drying effects of air flowing across the concrete slab.

Alternatively, corrugated metal roof deck is sometimes ordered with no vent slots. Providing expanded metal lath with 70% openings will not remove excess moisture from the concrete slab if air is blocked from flowing through the mini ducts formed in the valleys of the corrugated roof deck. Vent holes can be added to the valleys of the corrugated roof deck with a standard electric powered wheel grinder.

Our invention is a construction method where one rib of a corrugated metal deck between two valleys is cut by holding a grinder 45 degrees off vertical. The cut is perpendicular across the rib and 45 degrees down the sides of the adjacent valleys leaving the bottom of the valleys uncut. The wheel grinder is then rotated 90 degrees to −45 degrees off vertical. The two cuts join together just above the uncut valley bottom creating a rectangular hole in the top of the rib and two triangular holes in adjacent sides of the valleys. The rectangular hole in the rib is covered by the expanded metal lath that forms the top of the mini ducts and does not contribute to air flow in the mini ducts. The two triangular side holes in the adjacent sides of the valleys allow air to flow through the mini ducts and can replace the air flow normally provided by corrugated metal deck vent slots. This procedure can be repeated at regular intervals to provide the required area of venting equivalent to the venting area normally provided by corrugated metal roof deck with vent slots.

SUMMARY OF THE INVENTION

It is therefore the objective of our invention to provide a method of roof construction having increased venting properties through corrugated metal deck for the purpose of removing excess moisture from cementitious deck poured in place over corrugated metal roof deck.

It is a further objective of our invention to achieve increased venting properties by using already existing construction materials combined to create ducts between corrugated metal deck and poured in place cementitious roof deck.

It is a further objective of our invention to increase the efficiency of vent slots in the bottom of the valleys of vented corrugated metal deck by preventing concrete or wicking materials from blocking ventilation slots.

It is a further objective of our invention to provide a method of construction where a concrete form is placed over the corrugated deck to create air ducts in spaces of the metal deck valleys where said form is composed of a material that restrains poured in place cementitious deck from encroaching into the metal deck valleys while providing openings through said form that provides increased exposure of poured in place cementitious deck to air flow inside the above mentioned air ducts.

Alternatively, it is a further objective of our invention that an electric wheel grinder can be used to create vent holes in the sides of the corrugated metal deck valleys when said metal deck does not have proper ventilation to open space below the roof construction.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides enhanced ventilation for removing excess moisture trapped in a concrete roof slab enclosed by rubber roofing above and corrugated roof deck below. Drying of the concrete slab is enhanced by increasing the area on the bottom of the concrete slab exposed directly to air flow to the building space below. This is accomplished by preventing the concrete slab from filling the valleys of corrugated metal roof deck and thus creating mini ducts between the concrete slab and the corrugated roof deck. The top of the mini ducts are formed with expanded metal lath. The lath has 70% or more of its area consisting of openings. The openings are small enough so that the concrete can penetrate into the openings but can not flow through the openings. Air flow enters the mini ducts through venting slots in the bottom of the corrugated roof deck or through vent holes manually cut into the valleys of the corrugated roof deck with an electric grinding wheel.

Corrugated metal roof deck spans between and is attached to structural support members spaced apart in regular intervals. The corrugated metal roof deck comes manufactured with vent slots spaced evenly along the bottom of the valleys of the corrugated metal roof deck.

Alternately, if the corrugated metal roof deck does not have vent slots, v shape notch vent holes can be manually cut into the sides of the valleys of the corrugated metal roof deck at regular spacing.

Expanded metal lath is laid on top of the corrugated metal roof deck ribs for the entire length of the roof area. The expanded metal lath is fastened down to the corrugated metal roof deck at predetermined spacing with self tapping tek screws through the lath and into the corrugated metal roof.

The concrete roof slab is poured on top of the corrugated metal roof deck with mini ducts formed in combination with the metal lath. Reinforcing steel is also placed as required by the designer.

After the concrete slab partially cures, rigid insulation is adhered to the top of the concrete slab and the rubber roof is applied to the top of the rigid insulation. Moisture trapped in the concrete slab as it cures can dissipate into the building below through the venting system created as described above.

Figure 1:
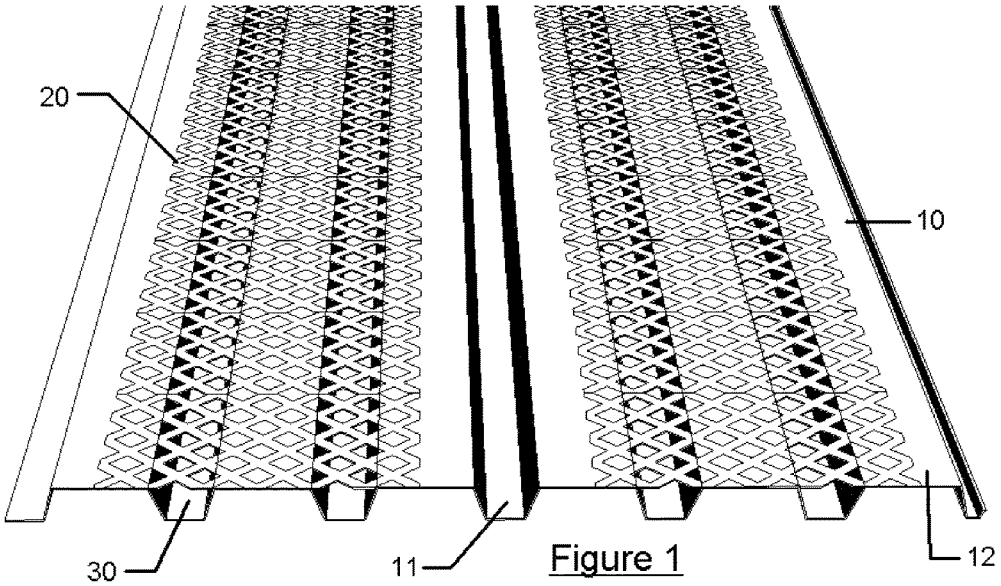
FIG. 1 is a plan view of corrugated metal roof deck layered with expanded metal lath to create mini ducts in the corrugations of the roof deck.

Referring now to FIG. 1, roof deck 10, typically manufactured from galvanized gauge metal steel is rolled into a continuous sheet and is bent into a shape with regularly spaced valleys 11 and ribs 12. Expanded metal lath 20 is laid on top of the roof deck 10 resting on top of the ribs 12. The deck valleys 11 and lath 20 form mini air ducts 30 providing a space for ventilation.

Figure 2:
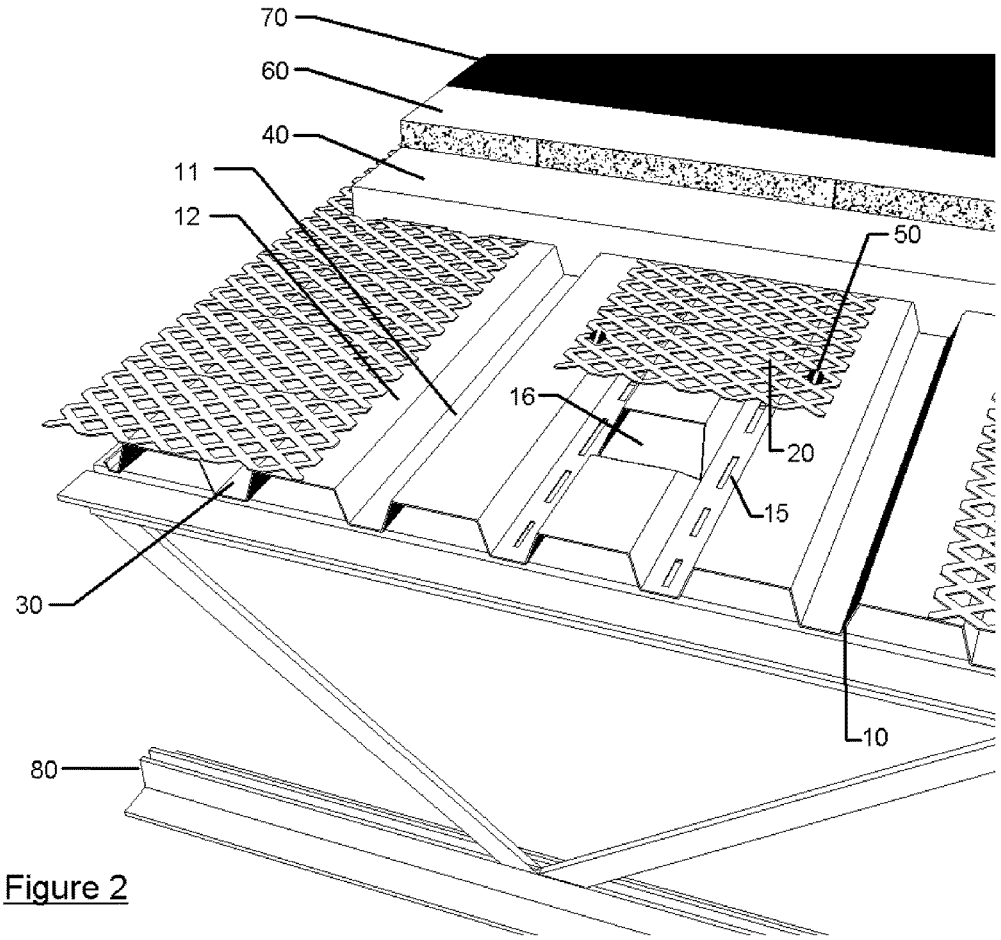
FIG. 2 is a isometric sectional view showing a step-wise construction of the present invention according to an exemplary embodiment of the present invention.

Referring now to FIG. 2, structural support members 80 are spaced at regular intervals. Multiple sheets of corrugated roof deck 10 manufactured with vent slots 15 at regular intervals along the bottom of the deck valleys 11 span between and are attached to structural support members 80.

Multiple sheets of expanded metal lath 20 are laid on top of the ribs 12 of the corrugated roof deck 10 to form multiple mini air ducts 30. Expanded metal lath 20 is fastened to corrugated roof deck 10 with self tapping tek screws 50 at regular intervals as required to prevent movement as a concrete slab is poured on top of the assembly.

Concrete slab 40 is poured in placed to a thickness as required by the designer. After the concrete slab 40 has cured long enough to accept adhesive of the rigid insulation 60 the roof assembly is completed with the addition of the rigid insulation 60 and the rubber roof 70.

Alternatively, if the corrugated roof deck 10 is not manufactured with vent slots 15, vent holes 16 can be manually cut into deck 10 at regular intervals with a standard electric grinding wheel in a v shape notch by cutting a slot at 45 degrees perpendicular to the rib 12 then rotating the grinding wheel 90 degrees to cut a second slot that joins the first slot at the bottom of the valley 11.

What is claimed is:

1. In a roof construction, in combination, a plurality of substantially rigid rectangular corrugated metal backing sheets, said sheets having a series of apertures formed therein, a plurality of expanded metal lath sheets layered on top of said backing sheets, said metal lath sheets having a series of apertures formed therein, said backing sheets and expanded metal lath joined together with self tapping screws at regular intervals, a layer of settable cementitious material on top of said sheets, said cementitious material bonding onto said expanded metal lath sheets and a waterproof finishing roof system covering said cementitious material.

2. The roof construction of claim 1 wherein the apertures formed in said backing sheets constitute approximately 1.5% of the surface area of the sheet.

3. The roof construction of claim 1 wherein the apertures in the corrugated metal backing sheets are v notches manually cut with a grinding wheel.

4. The roof construction of claim 1 wherein a plurality of twisted metal mesh sheets is substituted for a plurality of expanded metal lath sheets.

5. The roof construction of claim 1 wherein the finishing roof system is a continuous rubber roof over rigid insulation adhered to said cementitious material.

6. A method of constructing a roof comprising the steps of securing a plurality of substantially rigid corrugated sheets to horizontal roof joists, said sheets having a series of apertures formed in said backing sheets thereof and a plurality of expanded metal lath sheets covering and fastened to said backing sheets in substantially full contact therewith, pouring a layer of settable cementitious material on top of said sheets and said cementitious material bonding said metal lath sheets, allowing said cementitious material to set and harden, and covering said cementitious material with a waterproof finished roof system.

* * * * *